US006609334B1

(12) United States Patent
Gutermuth

(10) Patent No.: US 6,609,334 B1
(45) Date of Patent: Aug. 26, 2003

(54) CABLE-OPERATED WINDOW LIFTING MECHANISM WITH LATERAL DISPLACEMENT COMPENSATION

(75) Inventor: Andreas Gutermuth, Angelburg (DE)

(73) Assignee: Kuster Automotive Door Systems GmbH (DE)

( * ) Notice: Subject to any disclaimer, the term of this patent is extended or adjusted under 35 U.S.C. 154(b) by 0 days.

(21) Appl. No.: 09/555,615

(22) PCT Filed: Oct. 15, 1999

(86) PCT No.: PCT/EP99/07854

§ 371 (c)(1),
(2), (4) Date: Jun. 1, 2000

(87) PCT Pub. No.: WO00/21766

PCT Pub. Date: Apr. 20, 2000

(30) Foreign Application Priority Data

Oct. 15, 1998 (DE) ..... 198 47 588

(51) Int. Cl.[7] ..... B06J 1/17
(52) U.S. Cl. ..... 49/375; 49/226
(58) Field of Search ..... 49/352, 358, 375, 49/226, 227, 374, 372

(56) References Cited

U.S. PATENT DOCUMENTS

| | | | | | |
|---|---|---|---|---|---|
| 4,168,595 | A | * | 9/1979 | Pickles et al. | 49/352 |
| 4,418,498 | A | | 12/1983 | Wanlass et al. | |
| 4,449,326 | A | * | 5/1984 | Hori et al. | 49/375 |
| 4,700,508 | A | * | 10/1987 | Kollner et al. | 49/352 |
| 4,878,391 | A | * | 11/1989 | Komatsu et al. | 74/89.2 |
| 4,910,917 | A | * | 3/1990 | Brauer | 49/348 |
| 5,469,663 | A | * | 11/1995 | TenBrink et al. | 49/375 |
| 5,622,005 | A | * | 4/1997 | Ochenski et al. | 49/375 |
| 5,673,515 | A | * | 10/1997 | Weber et al. | 49/352 |
| 5,832,667 | A | * | 11/1998 | Buening et al. | 49/212 |
| 6,050,029 | A | * | 4/2000 | Simon et al. | 49/352 |
| 6,052,947 | A | * | 4/2000 | Smith | 49/352 |
| 6,141,910 | A | * | 11/2000 | Kobrehel et al. | 49/378 |

FOREIGN PATENT DOCUMENTS

| | | |
|---|---|---|
| DE | 36 16 537 C1 | 5/1986 |
| DE | 37 27 153 A1 | 8/1987 |
| EP | 0 188 212 A2 | 1/1986 |
| EP | 0844 355 A1 | 11/1997 |
| GB | 2 185 513 A | 1/1987 |

* cited by examiner

*Primary Examiner*—Gregory J Strimbu
(74) *Attorney, Agent, or Firm*—Foley Hoag LLP

(57) ABSTRACT

A cable window lifting mechanism lifts a window pane (5) in a vehicle, in particular an automobile, in a first direction. The window lifting mechanism includes two guide sections (1, 2), with two sliding elements (3, 4) each moveably guided on a respective one of the guide sections (2, 1). A cable (6) engages at least one sliding element (3, 4). Moreover, the window pane (5) is supported by both sliding elements (3, 4). One of the sliding elements (3) is guided on the associated guide section (2) so as to minimize movement of the one of the sliding elements normal to the first direction. The other sliding element (4) is guided at least over partial sections of the associated guide section (1) to minimize movement of the other sliding element normal to a plane of the window pane, while permitting a compensating movement of the other sliding element in the vehicle's longitudinal axis when the window pane (5) is displaced.

6 Claims, 4 Drawing Sheets

CABLE-OPERATED WINDOW LIFTING MECHANISM WITH LATERAL DISPLACEMENT COMPENSATION

FIELD OF THE INVENTION

The invention relates to a cable-operated window lifting mechanism for moving a window pane on a vehicle, in particular an automobile and the like, with two guide sections, on which a respective sliding element is movably guided, wherein the cable operates on at least one sliding element and the window pane is supported on each sliding element.

BACKGROUND OF THE INVENTION

A cable-operated window lifting mechanism having the aforedescribed characteristic features is described, for example, in DE-OS-37 27 153. In window lifting mechanisms of this type, the window pane to be moved is guided on each of the two guide rails. The window pane is held by carriers which in turn slide in the guide rails. In addition, the cable operates on the carriers and can be moved with a crank or by an electric motor drive, raising or lowering the window pane depending on the direction of rotation.

The two guide rails are separately mounted on the vehicle door and should ideally be oriented exactly parallel to one another. However, this can rarely be achieved in practice, since the location of the attachment holes in the guide rails and the corresponding bores in the vehicle door are subject to manufacturing tolerances. As a result, the guide rails mounted on the vehicle door are typically not oriented parallel to one another, which may not only make it difficult to move the window pane, but the window pane may actually jam. Problems during assembly may also cause non-parallelism of the guide rails. According to the state of the technology disclosed in the reference, difficult movement and possible jamming of the window pane can be prevented by providing at least one of the two carriers with adjusting means for adjusting the height of the window pane as well as with adjusting means for lateral displacement of the window pane transversely to the carrier and/or to the guide rail guiding the carrier.

EP 0 844 355 A1 discloses providing an elongated hole in carrier or in the support plate of the window pane for adjustment of the window pane in the longitudinal direction of the vehicle (X-axis). In this way, the window pane can move in the direction of the X-axis relative to the carrier and/or the window pane holder. The conventional compensation mechanisms are complex and have not proven successful in practical applications. Another problem is encountered in properly setting and adjusting the compensation mechanisms during the initial assembly of the cable-operated window lifting mechanism on the assembly line of the automobile manufacturer.

SUMMARY OF THE INVENTION

It is the object of the present invention to improve a cable-operated window lifting mechanism having the aforedescribed characteristic features in such a way that the non-parallelism of the two guide sections, which is almost always encountered in practice, can be easily compensated. It is another object of the invention to simplify the initial assembly of the window lifting mechanism and the initial adjustment of the compensation mechanism on the assembly line of the automobile manufacturer.

The object is essentially solved by a cable-operated window lifting mechanism having the aforedescribed characteristic features, by guiding one of the sliding elements with play at least over partial sections of the respective guide section in the direction of the longitudinal axis (X-axis) of the vehicle, thereby enabling a compensating motion in the direction of the X-axis when the window pane is displaced.

A possible non-parallelism of the two guide sections in the X-direction can be easily and permanently compensated by providing one of the sliding element with a degree of freedom in the direction of the X-axis, while the other sliding element which is guided on the respective guide section, is guided in a conventional manner essentially without play in the direction of the X-axis and the axis extending transversely to the vehicle (Y-axis). The respective two sliding elements guided on the guide sections form a stationary-moveable bearing pair, wherein the moveable bearing can easily compensate variations in the separation between the two guide sections. This design obviates the need for additional adjusting means to provide compensation. The window pane can also be rigidly connected with the sliding element or with the window pane holder.

According to a first advantageous embodiment of the invention, the other sliding element is guided in a conventional manner essentially without play in the direction of the X-axis and the transverse axis (Y-axis) on the associated guide section, whereas the one guide element is movable relative to the associated guide section in the direction of the X-axis, thereby providing compensation of a potential non-parallelism between the two guide sections.

According to yet another advantageous embodiment, the one sliding element is guided in the direction of the Y-axis essentially without play on the associated guide section, thereby further improving the guiding characteristics of the window pane with respect to the Y-axis.

According to yet another embodiment of the invention, the other sliding element is formfittingly guided on the respective guide section.

According to another embodiment of the invention, the other sliding element advantageously includes an arcuate groove which receives a respective arcuate marginal section of the associated guide section. This simple arrangement provides guiding of the other guide element in the direction of the Y-axis and X-axis on the associated guide section.

Advantageously, the one sliding element may include a groove extending in the direction of the X-axis, wherein a preferably angled marginal section, which extends in the direction of the X-axis, of the associated guide section is inserted towards the groove bottom with play. This arrangement provides clearance for the one sliding element in the direction of the X-axis, taking into account variations in the spacing between the two guide sections over their respective length, thereby preventing jamming and hard movement of the will pane.

The side walls of the groove and/or the legs of the groove are preferably formed as arcuate contact surfaces for the associated guide section, and make contact in the direction of the Y-axis of the guide section essentially without play. The contact surfaces have preferably a convex shape in the direction of the guide section, thereby significantly lowering the friction resistance between the sliding element and the guide section and guiding essentially without play in the direction of the Y-axis.

The one sliding element, and preferably also the other sliding element, consist of two functional parts, namely a slider and a window pane holder which are preferably connected with one another as one piece.

According to an advantageous embodiment of the invention, the slider has an essentially U-shaped profile, wherein the end face of one leg has an inwardly pointing nose or the like. The nose engages with play with a recess in the associated guide section.

Preferably, the leg of the slider and/or the sliding element has a center opening, thereby forming two crossbars having inwardly pointing noses on their respective ends. This arrangement further improves the guiding characteristics of the sliding element and/or the slider on the guide section.

According to yet another advantageous embodiment of the invention, which can be implemented independent of the aforedescribed measures, the guide section cooperating with the one sliding element includes a partial section, with the one sliding element or the slider also being guided essentially without play in the direction of the X-axis. This partial section of the guide section is small in relation to the entire length of the guide section and facilitates assembly of the window lifting mechanism on the assembly line of the automobile manufacturer, with provisions for adjustment and compensation.

More particularly, the one sliding element is positioned without play in the partial section of the guide section when the window lifting mechanism is supplied to the automobile manufacturer and/or installed on the vehicle. This measure provides well-defined assembly conditions regardless of the play the sliding element and/or the slider may experience in other regions of the guide section. In the supply and/or installation position, the sliding elements are connected with the window pane, reflecting the separation between the guide sections. Variations in the separation due to non-parallelism of the guide sections above and/or below the partial section can be compensated by displacing the one sliding element is and/or the slider with respect to the associated guide section outside this partial section.

According to a preferred embodiment, the guide section has an essentially U-shaped profile.

The nose of the sliding element or the slider is inserted into the U-shaped profile of the guide section, so as to provide reliable guiding in the direction of the Y-axis and guiding with play in the direction of the X-axis.

The U-shaped profile is tapered and/or the spacing of the side legs of the U-shaped profile decreases in the partial section over the longitudinal extent of the guide section, until the nose of the slider and/or the sliding element is received essentially without play between the side legs of the U-shaped profile.

Preferably, the partial section for guiding without play in the direction of the X-axis is located in a center section of the guide section, with sections guiding the slider in the direction of the X-axis with play extending outwardly from both sides of the guide section.

Advantageously, the spacing between the side legs of the U-shaped profile initially increases continuously, beginning at the one partial section, and remains essentially constant thereafter. These continuously expanding regions are formed in the shape of a funnel and can adjoin the partial section either above or below. In this way, the play in the direction of the X-axis gradually increases to a maximal possible value, beginning at the partial section.

The other leg of the U-shaped slider makes contact with the rear of the guide section essentially without play, with the nose resting essentially without play on one leg positioned in front of the bottom of the U-shaped profile. This arrangement provides precise guiding of the slider and/or the receiving element in the direction of the Y-axis.

Additional objects, advantages, characteristic features and applications of the present invention are described in the following description of embodiments to be read in conjunction with the drawings. The described and/or illustrated features alone or in combination form the subject matter of the present invention, independent of the combination recited in the claims or the claim dependency.

BRIEF DESCRIPTION OF THE DRAWINGS

It is shown in.

DETAILED DESCRIPTION OF CERTAIN ILLUSTRATED EMBODIMENTS

Figure 1:
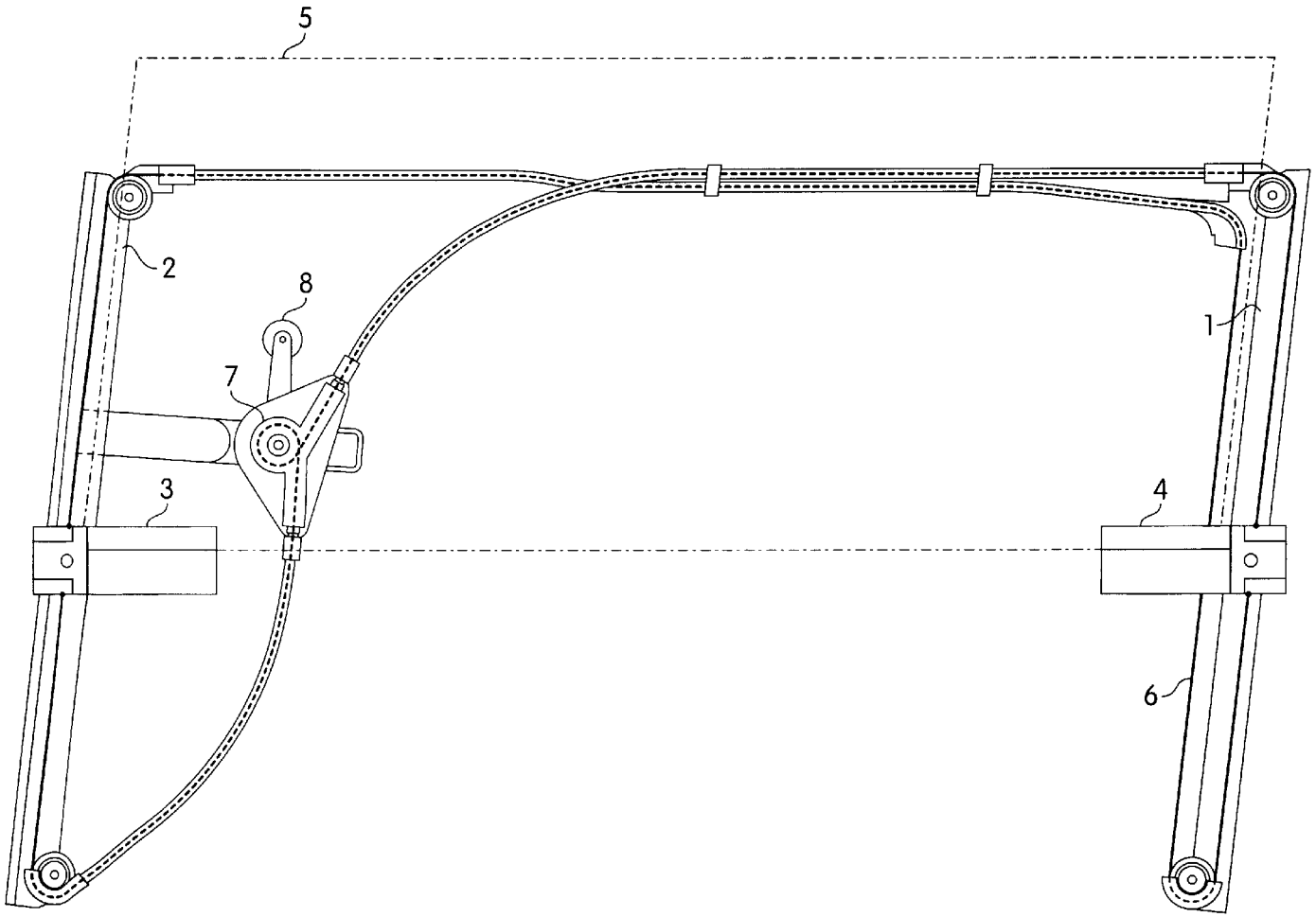
FIG. 1 an embodiment of a cable-operated window lifting mechanism according to the invention with two guide sections in which a respective guide element is movably guided, FIG. 2 an embodiment of a guide section and a sliding element shown in cross-section, which is guided essentially without play on the guide section in the plane of the cross-section, FIG. 2*a* an isometric view of the guide section of FIG. 2, FIG. 3 embodiment of a sliding element and guide section shown in cross-section according to the invention which is guided on a guide section in the direction of the X-axis with play and in the direction of the Y-axis essentially without play, FIG. 3*a* an isometric view of the guide section of FIG. 3, FIG. 4 another embodiment of a window lifting mechanism with a sliding element which is guided on a guide section in the direction of the X-axis with play and in the direction of the Y-axis essentially without play, and FIG. 5 a rear view of the embodiment of FIG. 4.

FIG. 1 illustrates a cable-operated window lifting mechanism with two guide sections 1, 2. Two sliding elements 3, 4 which together support the window pane 5, are movably guided on these guide sections 1, 2. Only the lower edge of the window pane 5 is shown in FIG. 1 as a dotted line. The cable 6 which is wound around a cable reel 7 in a manner known in the art, engages with the sliding elements 3, 4. The cable reel 7 can be set in rotation by a crank 8 or by an electrical drive motor. The cable 6 is a guided cross-wise between the guide sections 1, 2 in form of a Figure-Eight. When the cable reel 7 is set in rotation, the sliding elements 3, 4 cooperatively slide upwardly or downwardly on the guide sections 1, 2, depending on the rotation direction of the cable reel 7, thereby raising or lowering the window pane 5.

Figure 3:
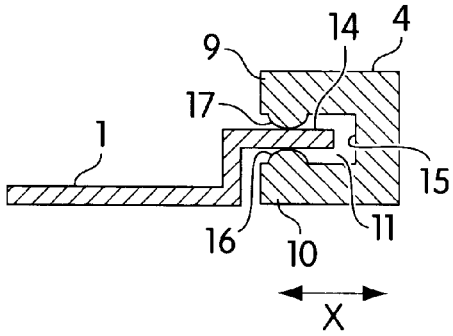
Figure 3A:
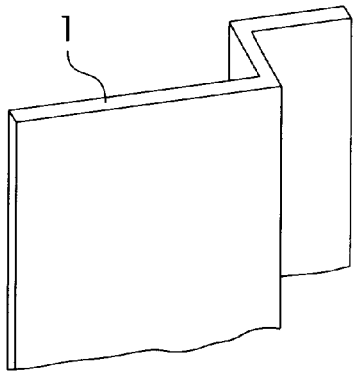

The guide sections 1, 2 may in practice not be aligned exactly parallel due to manufacturing or assembly tolerances. This can cause the window pane 5 to jam or be hard to move during the upward and downward travel of the window pane 5. This can be prevented, as shown in FIGS. 3, 3*a*, by making one of the sliding elements, in the illustrated embodiment the sliding element 4, moveable on the associated guide section 1 in the direction of the X-axis (longitudinal axis of the vehicle) with play, while allowing essentially no play in the direction of the Y-axis (transverse axis).

The sliding element 4 has a groove 11 oriented in the direction of the X-axis, wherein a preferably angled marginal section 14 of the associated guide section 1, which is oriented also in the direction of the X-axis, is inserted into the groove 11 towards the groove bottom 15 with play. The side walls and/or the legs 9, 10 of the groove 11 are preferably formed as curved contact surfaces 16, 17 for contacting the associated guide section 1, making contact with the guide section 1 and/or the marginal section 14 essentially without play in the direction of the Y-axis. This arrangement allows displacement of the sliding elements 4 relative to the guide section 1 and the angled marginal section 17 of the guide section 1 in the X-direction, since the free end of the marginal section 14 is spaced apart from the groove bottom 15.

Figure 2:
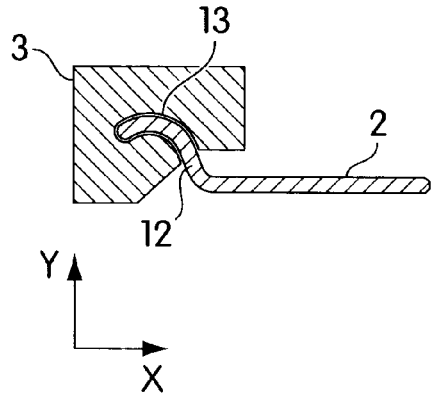
Figure 2A:
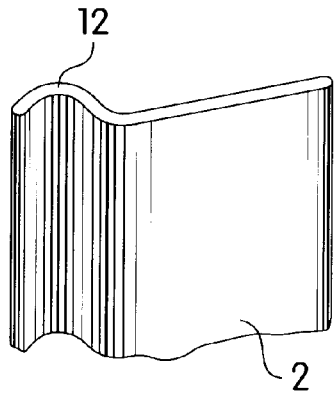

As seen in FIGS. 2, 2*a*, the other sliding element 3 is guided on the associated guide section 2 essentially without play in the direction of the X-axis and Y-axis. The other sliding element 3 includes an arcuate groove 13 which receives a respective arcuate marginal section 12 of the associated guide section 2. The other sliding element 3 is therefore guided on the associated guide section 2 relative to the X-axis and the Y-axis essentially without play. The underlying concept of the present invention is to form the guide of the one sliding element 4 relative to the X-axis as a moveable bearing and the guide of the other sliding element 3 as a stationary bearing. This arrangement permanently compensates variations in the separation between the guide sections 1, 2 in their respective longitudinal direction, thereby preventing jamming or difficult movement of the window pane 5 during the upward and downward movement.

Figure 4:
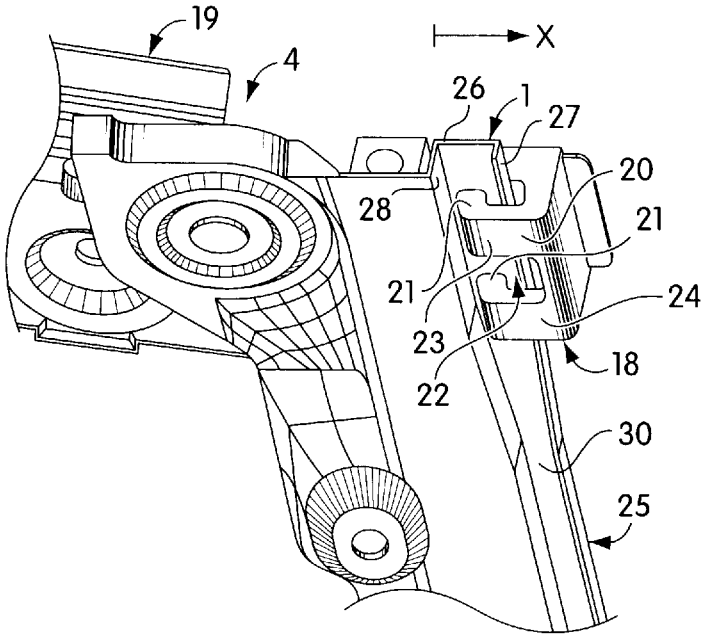
Figure 5:
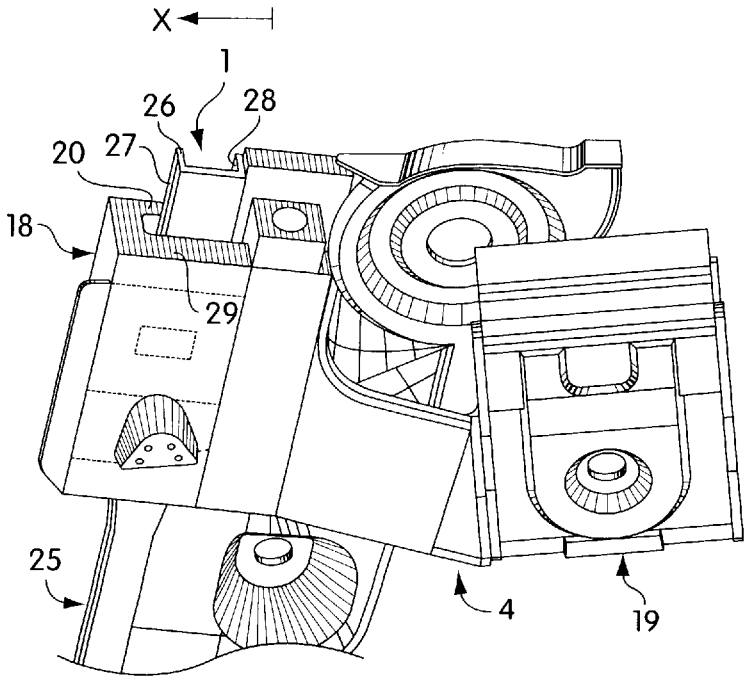

Whereas the embodiments depicted schematically in FIGS. 2, 2*a* and 3, 3*a* address the underlying principle of the invention, FIGS. 4, 5 illustrate a more practical embodiment of the invention.

As seen in FIGS. 4, 5, the sliding element 4 includes a slider 18 and a window pane holder 19 which are preferably connected with one another as one piece. The slider 18 is essentially formed in a U-shaped profile, with one leg 20, in FIG. 4 the front leg, having an inwardly pointing nose 21 or the like. This leg 20 has also a center opening 22, thereby forming two crossbars 23, 24 having inwardly pointing noses 21 located at their respective ends. The other leg 29 of the slider 18, illustrated in FIGS. 4, 5 as the rearward leg, makes contact with the rearward portion of the guide section 1 essentially without play, whereas the nose 21 of one leg 20 in the front is resting on the bottom 30 of the U-shaped profile 26 of the guide section 1 essentially without play. This arrangement reliably guides the slider 18 and/or the sliding element 4 on the guide section 1 essentially without play.

The guide section 1 for the sliding element 4 and/or the slider 18 include a section 25 which guides the sliding element 4 and/or the slider 18 also in the direction of the X-axis on the guide section 1 essentially without play. To facilitate assembly, the window lifting mechanism is supplied to the assembly line of the automobile manufacturer in a supply position, with the sliding element 4 and/or the slider 18 being located in the partial section 25 of the guide section 1. In this supply position, the window lifting mechanism is installed on the vehicle door of the automobile. Play or compensation during assembly are neither required nor permitted so as to furnish accurate installation conditions. Above and below the partial section 25, the guide section 1 once more includes play for the slider 18 and/or the sliding element 4, allowing a compensating displacement according to the invention in the direction of the X-axis.

Alternatively, with the embodiment of the sliding element according to FIGS. 2–3, the guide sections can be provided with a partial section in which the slider is guided in the X-direction essentially without play.

The guide section 1 has a substantially U-shaped profile 26, wherein the nose 21 of the sliding element 4 and/or the slider 18 are inserted into the U-shaped profile 26. The U-shaped profile 26 is tapered in the partial section 25 of the lengthwise extent of the guide section 1 until the nose 21 of the slider 18 or the sliding element 4 is received essentially without play between the side legs 27, 28 of the U-shaped profile 26. Preferably, the partial section 25 which guides the slider 18 without play, is arranged in the direction of the X-axis in a center section of the guide section 1. Both sides of the guide section 1 are adjoined by regions where the slider 18 is guided in the direction of the X-axis with play. The separation between the side legs 27, 28 of the U-shaped profile 26 preferably increases continuously, beginning at the partial section 25, and remains essentially constant thereafter. This arrangement provides for a smooth transition between the sections with play and the sections without play of the guide section 1.

In summary, the invention provides a window lifting mechanism with a simple compensation mechanism for compensating a potential non-parallelism between the two guide sections 1, 2. Moreover, the window lifting mechanism can also be easily installed on the assembly line of the automobile manufacturer and allows an automatic initial adjustment of the compensation mechanism during assembly. The initial adjustment is possible because the sliding element 4 in the supply position is disposed in a section of the guide section 1 where play is either insignificant or nonexistent in the direction of the X-axis.

What is claimed is:

1. A window lifting mechanism for raising and lowering a window pane in a vehicle in a first direction, comprising:

a first guide section extending longitudinally in a the first direction, a second guide section having a U-shaped profile extending longitudinally in the first direction, the second guide section having a base portion of the u-shaped profile being generally parallel to a plane of the window pane and having spaced apart leg portions of the u-shaped profile extending from the base portion in a direction normal to the base portion, a first sliding element supporting the window pane, the first sliding element movably guided on the first guide section to allow movement thereof in the first direction, the first sliding element interlocked with the first guide section to minimize movement of the first sliding element in a second direction normal to the first direction and generally parallel to the place of the window pane, a second sliding element supporting the window pane in a spaced apart relationship from the first sliding element, the second sliding element movably guided on the second guide section to allow movement thereof in the first direction, the second sliding element having front and rear leg portions respectively contacting front and rear sides of the base portion of the second guide section to minimize movement of the second sliding element in a third direction generally normal to the base portion, the front leg portion being positioned between the leg portions of the second guide section to allow a compensating movement of the front leg portion between the leg portions of the second guide section when the first and second sliding elements are misaligned, and a cable connected to at least one of the first and second sliding elements to move the first and second sliding elements on the first and second guide sections.

2. The window lifting mechanism according to claim 1, wherein the base portion is narrowed over a longitudinal extent of the second guide section to minimize movement of the second sliding element in the second direction between the leg portions of the second guide section in a center section of the second guide section.

3. The window lifting mechanism according to claim 2, wherein a spacing between the leg portions of the U-shaped profile initially increases continuously, beginning at the center section, and remains essentially constant thereafter.

4. A system for raising and lowering a window pane in a first direction in a vehicle comprising:

means for providing window pane support at two spaced apart locations on the window pane, first means for slidably guiding movement of a first one of the means for providing window pane support in the first direction and for minimizing movement of the first one of the means for providing window pane support in a second direction normal to the first direction and generally parallel to a plane of the window pane, second means for slidably guiding movement of a second one of the means for providing window pane support in the first direction and for minimizing movement of the second one of the means for providing window pane support in a third direction normal to the plane of the window pane, and means for permitting a compensating motion of the second one of the means for providing window pane support on the second means for slidably guiding movement to compensate for misalignment of the means for providing window pane support, the compensating motion being in the second direction, wherein the second means for slidably guiding movement includes means for minimizing movement of the second one of the means for providing window pane support in the second direction only over a partial section of the second means for slidably guiding movement.

5. The system according to claim 4, wherein the second one of the means for providing window pane support is positioned at the means for minimizing movement of the second one of the means for providing window pane support during one of transport and assembly of the system.

6. The system according to claim 4, wherein the partial section is located in a center section of the second means for slidably guiding movement, and the means for permitting a compensating motion extends longitudinally from both ends of the partial section.

* * * * *